United States Patent [19]

DeGidio

[11] 4,219,970

[45] Sep. 2, 1980

[54] SWINGING DOOR UNIT FOR A DOGHOUSE

[76] Inventor: George J. DeGidio, 8600 5th Ave. South, Minneapolis, Minn. 55420

[21] Appl. No.: 38,498

[22] Filed: May 14, 1979

[51] Int. Cl.[3] ..... E05D 7/081

[52] U.S. Cl. ..... 49/388; 49/501

[58] Field of Search ..... 49/388, 390, 501, 371, 49/398, 169, 171, 168; 52/802

[56] References Cited

U.S. PATENT DOCUMENTS

| | | | |
|---|---|---|---|
| 2,694,235 | 11/1954 | Jansen | 49/388 X |
| 2,901,782 | 9/1959 | Ullman, Jr. | 49/398 |
| 2,938,247 | 5/1960 | Hagerty | 49/390 |
| 3,056,475 | 10/1962 | Benham | 49/501 |
| 3,464,158 | 9/1969 | Greene | 49/388 X |
| 3,750,336 | 8/1973 | Johnson | 49/371 |
| 4,053,007 | 10/1977 | Griffith | 49/168 X |

*Primary Examiner*—Philip C. Kannan

*Attorney, Agent, or Firm*—Peterson, Palmatier, Sturm & Sjoquist, Ltd.

[57] ABSTRACT

A metal frame includes top, bottom and side members, each member having an angular cross section. A sheet metal door of unitary construction is formed with a tubular portion at its upper end and a pair of spaced panels depending therefrom. A pair of plastic bushings are loosely received in the opposite ends of the tubular portion, the bushings having flanges that determine the small amount of clearance between the door and the sides of the frame. A rod extends through the bushings and through the flanges of the angled side members to determine the small amount of clearance between the frame and the top and bottom of the door. In this way, the door is free to swing inwardly and outwardly, thereby permitting a dog to readily enter or leave the doghouse.

10 Claims, 5 Drawing Figures

ROVER

SWINGING DOOR UNIT FOR A DOGHOUSE

BACKGROUND OF THE INVENTION

This invention relates generally to a door for doghouses, and pertains more particularly to a swinging door that can be pushed in either direction by the dog as it enters or exits.

SUMMARY OF THE INVENTION

One object is to provide a swinging door unit for a doghouse that can be readily swung inwardly or outwardly by the dog. More specifically, an aim of the invention is to provide a sheet metal door of unitary construction having a tubular portion at its upper end into which a pair of plastic bushings extend which offer very little resistance to rotation.

Another object of the invention is to provide a swinging door unit for a doghouse that is both simple and exceptionally rugged, the door effectively resisting destruction by the dog, children, or weather.

Yet another object of the invention is to provide a swinging door unit having a door mounted for swinging movement within a rectangular frame, there being very little clearance between any portion of the door and frame in order to minimize air leakage.

Still further, the invention has for an object the provision of a swinging door unit for a doghouse that will be relatively inexpensive to manufacture, thereby encouraging its widespread use by dog owners.

Another object of the invention is to provide a swinging door unit that can be easily attached to any conventional doghouse by the dog's owner.

DESCRIPTION OF THE PREFERRED EMBODIMENT

Figures 1, 2, 3, 4, 5:
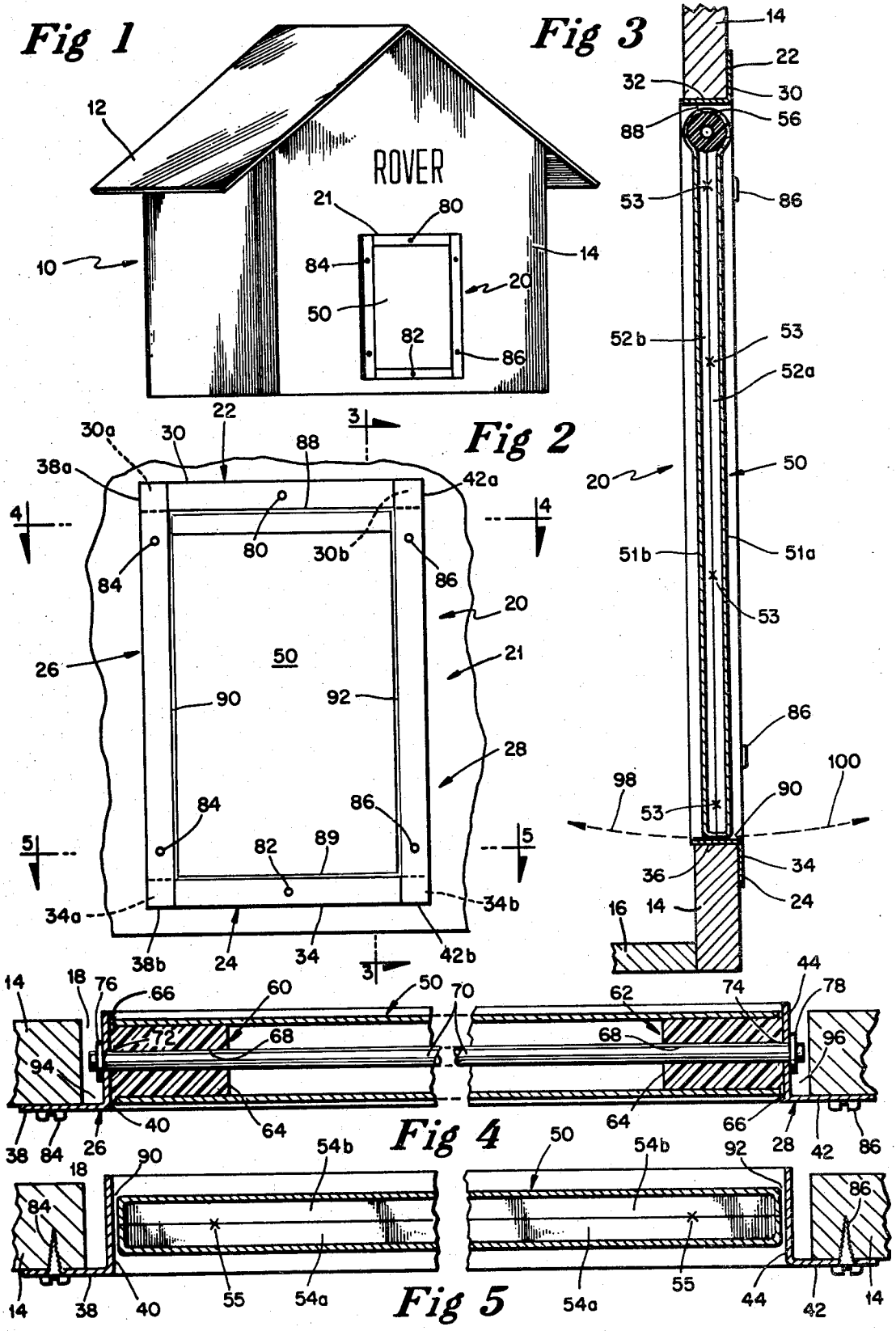
FIG. 1 is a front perspective view of a typical doghouse having my swinging door unit installed therein.
FIG. 2 is an enlarged front elevational view of the door unit shown in FIG. 1 with the surrounding portion of the front wall appearing fragmentarily.
FIG. 3 is a sectional view taken in the direction of line 3—3 in FIG. 2, the scale for FIG. 3 being still greater than that employed in FIG. 2.
FIG. 4 is a sectional view taken in the direction of line 4—4 of FIG. 2 for the purpose of illustrating the manner in which the door is pivotally mounted to the sides of the frame.
FIG. 5 is a sectional view taken in the direction of line 5—5 of FIG. 2 so as to show the small clearance at each side of the door resulting from the mounting depicted in FIG. 4.

In order that the benefits of my invention can be fully appreciated, a typical doghouse 10 has been shown in FIG. 1, the doghouse conventionally having a roof 12, the usual vertical walls including a front wall 14, and a floor 16 (fragmentarily appearing in FIG. 3). From FIGS. 4 and 5 it will be discerned that there is an opening 18 formed in the front wall 14.

My swinging door unit has been denoted generally by the reference numeral 20. The unit 20 includes a rectangular metal frame 21 having a top member 22, a bottom member 24 and side members 26, 28.

The top member 22 is composed of a vertical flange 30 and an inwardly directed horizontal flange 32 (FIG. 3). The vertical flange 30 is somewhat longer than the horizontal flange 32 so as to provide extensions 30*a* and 30*b* (FIG. 2) at the opposite ends.

The bottom member 24 is virtually the same as the top member 22. More specifically, the bottom member 24 is comprised of a vertical flange 34 and an inwardly directed horizontal flange 36 (FIG. 3). Here again, the vertical flange 34 is somewhat longer than the horizontal flange 36 so as to provide extensions 34*a* and 34*b* (FIG. 2) which project beyond the ends of the horizontal flange 36.

As far as the side member 26 is concerned, it has a front flange 38 and an inwardly directed flange 40 (FIGS. 4 and 5). In this instance, the flange 38 is somewhat longer than the flange 40 so as to provide extensions 38*a* and 38*b* (FIG. 2) which overlap the previously mentioned extensions 30*a* and 34*a*.

The other side member 28 has a front flange 42 and an inwardly directed flange 44 (FIGS. 4 and 5). The flange 42 in this instance is somewhat longer than the flange 44 so as to provide upper and lower extensions 42*a* and 42*b* (FIG. 2).

The extension 30*a* is spot welded to the extension 38*a*, the extension 30*b* to the extension 42*a*, the extension 34*a* to the extension 38*b* and the extension 34*b* to the extension 42*b*. In this way, a rigid frame 21 is formed.

Playing an important role in the practicing of my invention is a sheet metal door 50 of unitary construction. The door 50 is formed with spaced panels 51*a* and 51*b*. In this regard, there are inturned flanges 52*a* and 52*b* on the two panels 51*a*, 51*b*, the edges of which are welded at spaced locations labeled 53. Also, there are bottom flanges 54*a* and 54*b* that are welded at spaced locations 55.

It has already been explained that the door 50 is of one-piece construction. At its upper end is a tubular portion 56 that can be rolled into its cylindrical configuration, as can be seen in FIG. 3. The door 50 can be stamped from thin sheet metal stock so as to permit the forming or rolling of the tubular portion 56, the removal of portions of the flanges 52*a* and 52*b* permitting this to be done. The tubular portion 56 does not constitute a true cylinder, for as is evident from FIG. 3 the tubular portion 56 is open at the bottom where the portion 56 is integrally joined to the spaced panels 51*a*, 51*b*, the spacing being provided by the inturned flanges 52*a*, 52*b*.

Loosely received in the opposite ends of the tubular portion 56 are plastic bushings 60 and 62. The bushings 60, 62 are identical and can be molded or otherwise formed from suitable plastic, such as nylon, polyethylene or ABS. It is actually the cylindrical portion 64 of each bushing 60, 62 that is received within the ends of the tubular portion 56. It is of importance to note that each bushing 60, 62 has formed thereon a thin, integral flange 66 which performs a spacing function as will presently be referred to. Still further, each bushing 60, 62 has a bore or passage 68 extending completely therethrough.

In mounting the door 50 to the frame 20, a rod 70 is utilized which extends through the passages 68 of the two bushings 60, 62, the rod 70 being sufficiently long so that its opposite ends project beyond the opposite ends of the tubular portion 56. The flanges 40 and 44 of the side members 26 and 28, respectively, have holes 70, 72 formed therein for the accommodation of the opposite ends of the rod 70. Suitable retainers 76 and 78, such as castellated washers, can be pressed onto the projecting ends of the rod 70 so as to keep the rod from shifting.

From FIGS. 1 and 2, and also from FIG. 5, it will be seen that a plurality of screws are employed in anchoring the frame 21 within the opening 18. More specifically, a single screw 80 extends through a hole in the flange 30 of the top member 22 into the wall 14, and a similar screw 82 extends through a hole in the flange 34 of the bottom member 24. Owing to the length of the side members 26, 28, it is planned that two screws 84 extend through the flange 38 of the side member 26 and two screws 86 extend through holes formed in the flange 42 of the other side member 28.

The holes 72 and 74 in the flanges 40 and 44, respectively, are at a height which positions the rod 70 so as to provide only a small clearance at 88 (FIGS. 2 and 3) between the flange 32 of the top member 22 and the tubular portion 56. Also the proper locating of the rod 70 provides only a small clearance 89 at the lower end of the door 50, that is, between the underside of the flanges 54*a*, 54*b* and the flange 36 of the bottom member 24. Hence, the door 50 should be fabricated with a length or height that is for all intents and purposes only ⅛" less than the distance between the flanges 32 and 36 (FIG. 3). This provides only 1/16" clearance at 88 and 1/16" clearance at 89.

The clearance labeled 90 at the left side and the clearance 91 at the right side of the door 50 should be on the same order as the clearances 88 and 89. Thus, the width of the door 50 will be approximately ⅛" less than the distance between the flanges 40 and 44 (FIG. 4). This will provide 1/16" clearance at each side and this 1/16" clearance is provided by the two previously mentioned flanges 66, one flange being on the bushing 60 and the other flange on the bushing 62. Stated somewhat differently, the thickness of the flanges 66 on the two bushings 60 and 62 should have a thickness of 1/16" so as to provide the proper spacing or clearance.

As far as clearances are concerned, the above clearances are determined at the factory. However, the installer of my door unit 20 should make the width of the opening 18 in the front wall 14 sufficiently wide so as to provide a clearance at 94 and a clearance at 96 (FIG. 4) that are adequate to accommodate the projecting ends of the rods 70. Considerable leeway is afforded the installer in forming the opening 18, for it is only necessary to leave enough of the wall 14 to accommodate the screws 84 and 86. Virtually the same thing can be said for the top and bottom of the opening 18. In this instance, however, there does not have to be any spacing, such as the clearance 94 and the clearance 96, because there is nothing to accommodate other than the flanges 32 and 36. While a snug fit is shown in FIG. 3, it will be appreciated that there can be a sizable amount of clearance beneath the flange 32 and above the flange 36 as long as the screws 80, 82 can enter the portions of the wall 14 bordering the top and bottom of the opening 18.

When mounted in the front wall 14 of the doghouse 10, it should be readily apparent that the door 50 is free to swing inwardly in the direction of the arcuate arrow 98 and outwardly in the direction of the arcuate arrow 100, as illustrated in FIG. 3. The shell or hollow configuration of the door 50 resulting from the spacing of the panels 51*a*, 51*b* makes the door sufficiently lightweight so that it can be easily swung by even a small dog brushing thereagainst.

The swinging movement isfacilitated by reason of the extremely low coefficient of friction between the tubular portion 56 and the cylindrical portions 64 of the two plastic bushings 60 and 62.

It should be recognized, though, that the rod 70, while extending through holes 72 and 74, does not rotate. This is to be avoided because the rotation of the metal rod 70 would cause the holes 72, 74 to become progressively larger over a period of time with the result that the door 50 would settle downwardly and the lower end ultimately strike the bottom frame member 24. With the bushings 60 and 62 functioning as bearings for the opposite ends of the tubular portion 56, it follows that there is for all intents and purposes absolutely no wear and the door 50 will remain properly suspended so that neither the clearance 88 at the top increases nor the clearance 89 at the bottom decreases.

Of course, the presence of the flanges 66 at each side prevent any lateral movement of the tubular portion 56 and hence prevent any lateral movement of the panels 52*a*, 52*b* with the consequence that the door 50 remains properly centered and the clearances 90 and 91 do not change.

It is of importance to appreciate that the door 50 is entirely of sheet metal and is therefore virtually indestructible, either by dogs, children, or the weather. Consequently, my door unit 20 will last indefinitely.

I claim:

1. A swinging door unit for a doghouse comprising a rectangular frame adapted to be mounted in a vertical wall of a doghouse, a door including first and second spaced sheet metal panels and a generally tubular sheet metal upper portion, said sheet metal tubular portion being integrally connected to the upper edges of said sheet metal panels, bearing means in said sheet metal tubular portion providing spaced cylindrical portions loosely received in encircling sections of said sheet metal tubular portion, and means engaging the sides of said frame near the upper ends thereof so that the spaced cylindrical sections of said bearing means rotatably journal said tubular portion, whereby the door is free to swing in opposite directions.

2. A swinging door unit in accordance with claim 1 in which said panels have inturned side flanges with the edges of said inturned flanges abutting each other.

3. A swinging door unit in accordance with claim 2 in which said panels also have inturned lower flanges to provide additional abutting edges at the bottom of the door.

4. A swinging door unit in accordance with claim 3 in which the abutting edges of said side flanges, and the abutting edges of said lower flanges, are welded to each other at spaced locations.

5. A swinging door unit for a doghouse comprising a rectangular frame adapted to be mounted in a vertical wall of a doghouse, a door including first and second spaced sheet metal panels and a generally tubular sheet metal upper portion, said sheet metal tubular portion being integrally connected to the upper edges of said sheet metal panels, bearing means including a pair of bushings, each bushing having a cylindrical portion loosely received in one end of said tubular portion and having a flange confronting said one tubular end portion, and means engaging the sides of said frame near the upper ends thereof so that said bushings rotatably journal said tubular portion, whereby the door is free to swing in opposite directions.

6. A swinging door unit in accordance with claim 5 in which the flanges of said bushings also confront the sides of said frame, thereby spacing the ends of said tubular portion from said frame and thus determining the clearance of said panel means with respect to the sides of said frame.

7. A swinging door unit in accordance with claim 6 in which said anchoring means includes a rod extending through said bushings, and through the sides of said frame, said frame having holes for receiving the projecting ends of said rod.

8. A swinging door unit in accordance with claim 5 in which the locations of said holes determine the position of said rod and thus the clearance of said tubular portion with respect to the top of said frame and also the clearance of the lower end of said panel means with respect to the bottom of said frame.

9. A swinging door unit in accordance with claim 8 in which said frame is composed of four angle members joined together at their ends to form flanges for confronting the marginal portions of the doghouse wall bordering the opening therein, said angle members also having inwardly directed flanges, and the inwardly directed flanges at the sides of said frame having said holes which receive the projecting ends of said rod.

10. A swinging door unit in accordance with claim 9 including a retaining element pressed onto each projecting rod end, one of said retaining elements confronting one of said inwardly directed side flanges and the other of said retaining elements confronting the other of said inwardly directed side flanges.

* * * * *